US005716006A

United States Patent [19]

Lott

[11] Patent Number: 5,716,006

[45] Date of Patent: Feb. 10, 1998

[54] JET PUMP HAVING AN IMPROVED NOZZLE AND A DIFFUSER

[76] Inventor: William Gerald Lott, 1857 Post Oak Park Dr., Houston, Tex. 77027

[21] Appl. No.: 623,696

[22] Filed: Apr. 15, 1996

[51] Int. Cl.[6] ..... B05B 7/30

[52] U.S. Cl. ..... 239/318; 239/434; 239/587.4

[58] Field of Search ..... 417/194, 151, 417/198; 239/601, 8, 9, 10, 318, 310, 587.3, 587.4, 434, 420

[56] References Cited

U.S. PATENT DOCUMENTS

| | | | |
|---|---|---|---|
| 419,126 | 1/1890 | Jones | 417/198 |
| 465,590 | 12/1891 | Burke | 417/198 |
| 3,207,445 | 9/1965 | Court et al. | 239/318 |
| 3,282,227 | 11/1966 | Nielsen | 239/318 X |
| 3,687,375 | 8/1972 | Griffiths | 239/601 X |
| 3,785,560 | 1/1974 | Hruby | 239/601 X |
| 3,796,377 | 3/1974 | O'Hare | 239/428.5 |
| 4,009,831 | 3/1977 | Arad et al. | 239/315 |
| 4,072,270 | 2/1978 | Harmony | 239/428.5 |
| 4,134,548 | 1/1979 | Harmony | 239/428.5 |
| 4,218,013 | 8/1980 | Davison | 239/74 |
| 4,426,040 | 1/1984 | Smith | 239/428.5 |
| 4,607,793 | 8/1986 | Eberle | 239/318 |
| 5,333,789 | 8/1994 | Garneys | 239/318 |
| 5,560,547 | 10/1996 | Mutter et al. | 239/601 X |
| 5,628,623 | 5/1997 | Skaggs | 417/198 X |

FOREIGN PATENT DOCUMENTS

| | | | |
|---|---|---|---|
| 519800 | 7/1980 | France | 417/198 |

*Primary Examiner*—Kevin Weldon
*Attorney, Agent, or Firm*—Maryam Bani-Jamali

[57] ABSTRACT

This invention provides a jet pump comprising: a three-dimensional axisymmetric nozzle with a top end and a bottom end, a mixing chamber with a top section and a bottom section, a conical diffuser with a top end and a bottom end, a distributor of a shower cap and an induction passage. The top section of the mixing chamber neighbors the bottom end of the nozzle. At a distal downstream end of the bottom section of the mixing chamber is the top end of the diffuser. The distributor is connected to the bottom end of the diffuser. The nozzle, the mixing chamber, the conical diffuser and the distributor share a longitudinal axis which is perpendicular to longitudinal axis of the induction passage. A pressurized first fluid is injected through an inlet orifice of the top end of the nozzle. Loss of pressure at periphery of the bottom end of the nozzle draws, by suction, a second fluid through the induction passage into the mixing chamber wherein the first fluid and the second fluid are thoroughly mixed to form an entrained mixture. The entrained mixture flows through the mixing chamber into the diffuser wherein sufficient chaotic turbulence is created to minimize wall separation, frictional losses and dissipation of energy to realize substantial recovery of the static pressure that was lost in the nozzle. The diffused mixture is then dispelled from the jet pump through the distributor of the shower cap.

12 Claims, 9 Drawing Sheets

FIG. 6 A
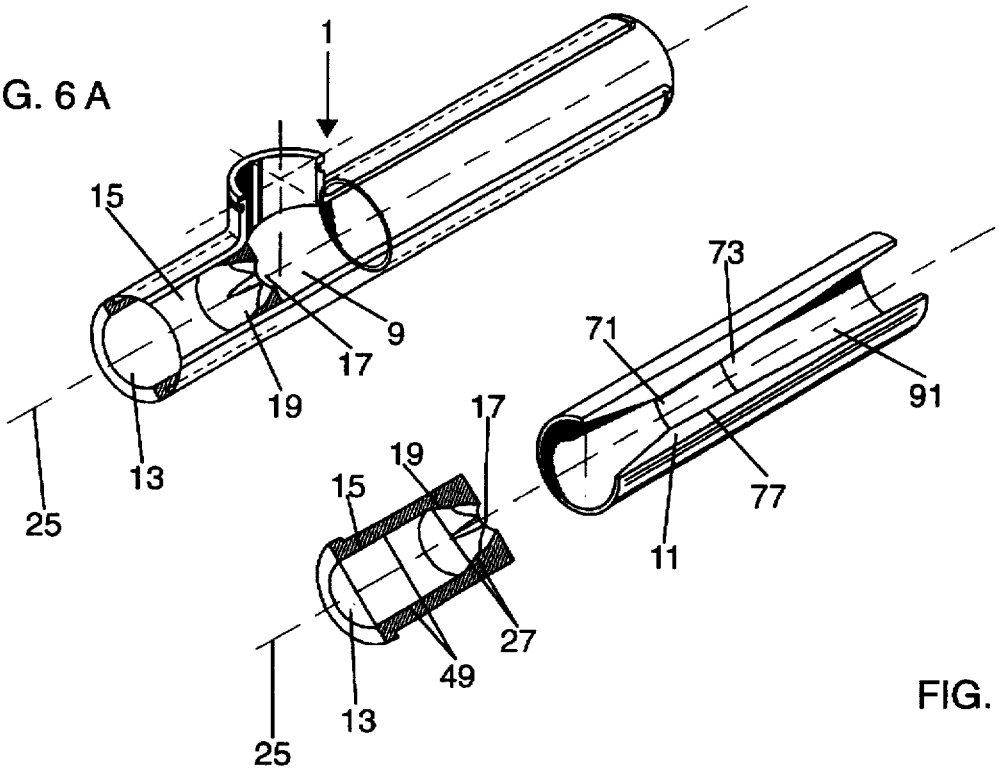
FIG. 6 B
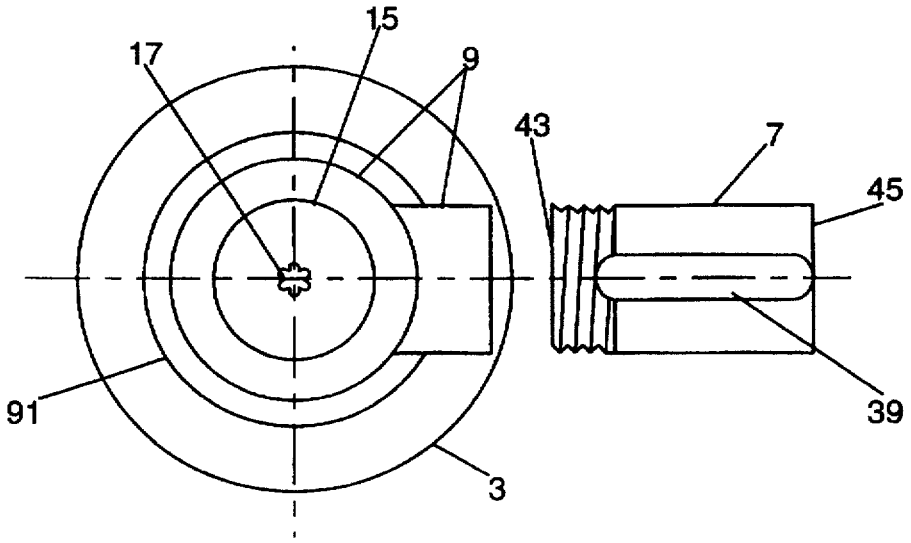
FIG. 7

JET PUMP HAVING AN IMPROVED NOZZLE AND A DIFFUSER

BACKGROUND OF THE INVENTION

1. Field of the Invention

This invention relates to an improved jet pump, serving as a shower head and having an improved nozzle, an induction passage, a mixing chamber, a diffuser, a distributor and a spray cap, for uniformly mixing and then dispensing fluids.

2. Description of the Prior Art

A wide variety of ejectors, such as shower heads, have been designed in the past to mix and dispense fluids. For shower heads, the mixed fluids usually consist of water, provided from a water inlet pipe, and a second fluid, commonly a body care product such as shampoos, conditioners and soaps, which is stored in a number of reservoirs or containers. The second fluid is drawn from the chosen reservoir into the ejector. A manually-operated valving arrangement is employed to allow a user to selectively control the delivery of and the amount of the second fluid from its reservoir. Generally, a flexible conduit is used to transport the second fluid from the reservoir to the ejector.

Said ejectors are nozzles wherein flow of fluids is limited to a primary axial flow and a secondary axial flow (i.e. two-dimensional flow) and wherein mixing has been solely based on turbulence created at perpendicular intersection of the fluids. A pressurized fluid that enters said mixing nozzles undergoes a transitional increase in velocity and, simultaneously, a transitional decrease in pressure. Based on Bernoulli's principle, "in a streamline, laminar flow of a fluid, the pressure is greatest when the fluid velocity is least, and the pressure is least where the velocity is greatest". Conversion of pressure into velocity results in a loss of pressure, creating a region of lower pressure by exiting the end of the nozzle in comparison with pressure of entering end of the nozzle. Said pressure loss enables suction of a second fluid from a reservoir into the ejector and mixing of the two fluids in the ejector.

Some examples of patents that have been issued in the past few decades and are focused on development of ejectors follow:

Garneys, U.S. Pat. No. 5,333,789, issued on Aug. 2, 1994, patents a dispenser insert for inserting a liquid additive from a container into a water inlet stream from an inlet pipe in a shower head. The dispenser insert comprises a cylindrical body member, a baffle, a first passage and a second passage. The baffle divides the cylindrical body member into an inlet chamber and an outlet chamber connected to one another at one end by a longitudinal passage, at an opposite end to a shower head and to an outlet pipe, respectively, and at a side wall to the first passage and to the second passage, respectively. An orifice in the baffle constricts flow of water and produces lower pressure in the outlet chamber. A portion of the water in the inlet chamber is diverted into the first passage, forcing and displacing the liquid additive from the container, via the second passage, into the outlet chamber.

Eberle, U.S. Pat. No. 4,607,793, issued on Aug. 26, 1986, patents a shower head which uniformly dispenses and mixes liquid additive with shower water. The shower head dispenser comprises an inlet chamber having a water inlet, connected to a source of water under pressure, and an outlet connected to the inlet chamber via a small-diameter passage. A number of containers of one or more liquid additives are connected through a supply line to a manually-operated valve which selectively connects each supply line to the passage. Based on Bernoulli's principle, flow of water draws liquid additive from the desired chamber and mixes the additive with the water which is then dispensed through the outlet.

Smith, U.S. Pat. No. 4,426,040, registered on Jan. 17, 1984, discusses a water-saving, adjustable, aerating shower head. The shower head provides water which is in an air-borne atomized form in a normal, continuously expanding pattern, and which has an adjustable water concentration that is substantially homogeneous in cross-section.

Davison, U.S. Pat. No. 4,218,013, issued on Aug. 19, 1980, patents a shower head fluid mixer and dispenser with a suspendible reservoir that is removably connected to the shower head. A valve block connects the shower head and a water supply pipe and selectively dispenses one of a plurality of fluids of the reservoir into the water. A valve is used to channel a select fluid into the shower head and another valve is used to selectively control the amount of fluid dispensed through the shower head. Mixing of the select fluid and the flowing water is dependent on any interacting turbulence existing at intersection of stream of water and stream of the select fluid.

Harmony, U.S. Pat. No. 4,134,548, issued on Jan. 16, 1979, patents a shower head aerator, inserted between a water pipe and a shower head. Based on Bernoulli's principle, upon formation of a low pressure region, ambient air is introduced into the shower head and is mixed with water within the shower head, causing a substantial reduction in water consumption. Harmony, U.S. Pat. No. 4,072,270, issued on Feb. 7, 1978, is based on the same invention, with one major difference: '270 claims an ejector apparatus while '548 claims an aerator.

Arad et al., U.S. Pat. No. 4,009,831, registered on Mar. 1, 1977, discusses a combined shower head and dispenser which is constructed to divide a single stream of water into a plurality of streams of water. The apparatus comprises a fluid chamber, an additive chamber, a mixing chamber and a rotational, plate-orifice, control means for selectively controlling introduction of water mixed with the additive into the mixing chamber.

O'Hare, U.S. Pat. No. 3,796,377, registered on Mar. 12, 1974, discusses a combined aerator and shower nozzle that is adjustable to permit control of size of stream openings so that water jets may be varied in size and force. The nozzle comprises an upstream plate and a downstream plate that are closely spaced, perforated and positioned on different ends of a chamber. Perforations of the upstream plate are aligned with and are larger than perforations of the downstream plate. Based on the venturi effect, any water exiting under pressure through the perforations of the upstream plate and then through the perforations of the downstream plate draws air from the aerator through the perforations in the downstream plate. Turbulence, developed in a mixing chamber that is positioned just below the downstream plate, completes mixing of the air and water before the water reaches apertures of the nozzle.

The above-listed ejectors (mostly shower heads in the above sample patents) and many other ejectors have been developed, some of which still exist in the market. However, in these ejectors mixing has been solely based on and considered in reference to turbulence created at intersection of the first fluid and the second fluid. Flow of fluids in these ejectors has been limited to a primary axial flow and a secondary axial flow. In these ejectors, and in principle in venturi style dispensing methods of introducing a second fluid into an ejector, it is clear that there has been no consideration given to pressure recovery after the kinetic energy has been converted from static pressure into velocity. Three-dimensional nozzles generate strong, coherent vortices and, as a result, chaotic turbulence and an increase in energy in the mixing chamber. Said increased energy is transferred forward into the diffuser. The strong, coherent vortices energize the boundary layer in the diffuser without wall separation. Since an expanding center-line core jet in the diffuser energizes any near-wall fluid, high pressure recovery is achieved.

SUMMARY OF THE INVENTION

A primary object of the invention is to devise an improved jet pump wherein pressure is recovered after the static energy has been converted from static pressure into velocity and after the fluids have been mixed.

Another object of this invention is to provide an improved jet pump that provides a three-dimensional flow of fluids.

Yet another object of this invention is to provide an improved jet pump that shortens length of a diffuser used in the jet pump and limits fluid energy losses in the jet pump.

An additional object of this invention is to devise an improved jet pump that is safe, secure, aesthetically pleasing, simple in operation, readily and easily installable and easily replaceable by a user, durable in construction, and simultaneously economical to produce and use.

Another object of this invention is to devise a means of mixing and dispensing through an improved jet pump that will provide sufficient loss in pressure to draw in a regulated second fluid at varied pressure ranges.

Still another object of this invention is to provide a blended and homogeneous stream exiting from orifices of a spray cap of an improved jet pump.

A final object of this invention is to provide a means of water conservation as an optional selection.

Additional objects and advantages of the invention will be set forth in part in a detailed description which follows, and in part will be obvious from the description, or may be learned by practice of the invention.

Despite different configurations and variations of ejectors and nozzles, development of ejectors and nozzles has been an attempt to achieve one major goal: optimum uniformity of and capability of entrainment and mixing in the shortest time and length scale. In general, the present invention has been developed against the above background to provide an improved jet pump that is capable of generating a three-dimensional flow. In a three-dimensional axisymmetric nozzle, chaotic turbulent flow is generated in a first fluid, with coherent vortices transferred through a mixing chamber. In the mixing chamber, a second fluid, drawn into the mixing chamber by suction, is thoroughly mixed with the first fluid to form an entrained mixture which is emitted through a diffuser wherein static pressure lost in the nozzle is significantly recovered.

The improved jet pump comprises an improved nozzle, an induction passage, a mixing chamber, a diffuser, a distributor and a spray cap and may be used as a shower head. (It should be noted that use of said improved jet pump is not limited to its use in a shower head and that said improved jet pump may have many other applications in different devices and systems.) The three-dimensional nozzle has a top end and a bottom end. An inlet orifice exists at the top end of the three-dimensional nozzle, said top end being connected to a suitable source of and serving as an entrance for a pressurized first fluid (e.g. water). The three-dimensional nozzle also has a bottom end forming an outlet orifice through which the first fluid exits the nozzle. Flow of the first fluid through the nozzle results in a loss in pressure of the first fluid and an increase in velocity of the first fluid. Said reduction of pressure in the nozzle results in suction of the second fluid from the source of the second fluid, through the induction passage and into the mixing chamber. Three-dimensional nozzles generate strong, coherent vortices and, as a result, chaotic turbulence and an increase in energy in the mixing chamber. Said increased energy is transferred forward into the diffuser. Since wall separation causes back pressure, the diffuser is hydrodynamically designed such that the strong, coherent vortices would be able to energize the boundary layer in the diffuser without wall separation. Since an expanding center-line core jet in the diffuser energizes any near-wall fluid, high pressure recovery is achieved. The diffused mixture then enters the distributor wherein the diffused mixture is uniformedly distributed into the spray cap to be sprayed from orifices in the spray cap.

It is to be understood that the descriptions of this invention are exemplary and explanatory, but are not restrictive, of the invention. Other objects and advantages of this invention will become apparent from the following specification and from any accompanying charts, tables, examples and drawings.

BRIEF DESCRIPTION OF CHARTS, TABLES, EXAMPLES AND DRAWINGS

Any accompanying charts, tables, examples and drawings which are incorporated in and constitute a part of this specification, illustrate examples of preferred embodiments of the invention and, along with the description, serve to explain the principles of the invention.

FIG. 6A shows a partial cross-sectional perspective view of a version of a jet pump that may be used in FIG. 1.

FIG. 6B shows a partial cross-sectional, partial-exploded, perspective view of portions of the jet pump of FIG. 6A.

FIG. 7 shows a top view of a version of the improved jet pump of FIG. 1.

DETAILED DESCRIPTION OF THE PREFERRED EMBODIMENT

Preferred embodiments of the present invention are illustrated in any charts, tables, examples and drawings that are included.

Figure 1:
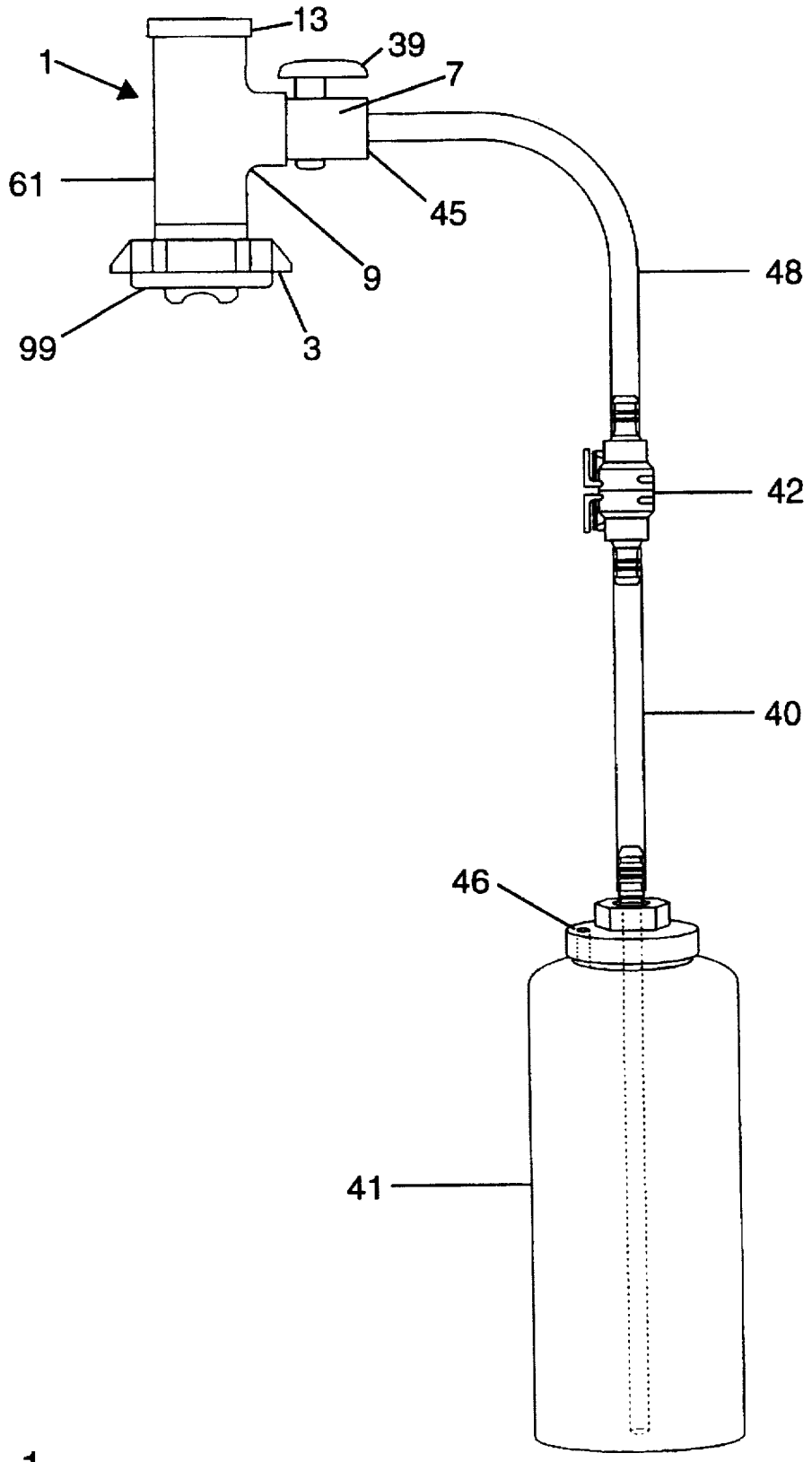
FIG. 1 shows a side view of an improved jet pump connected to a source of a second fluid.
Figure 2:
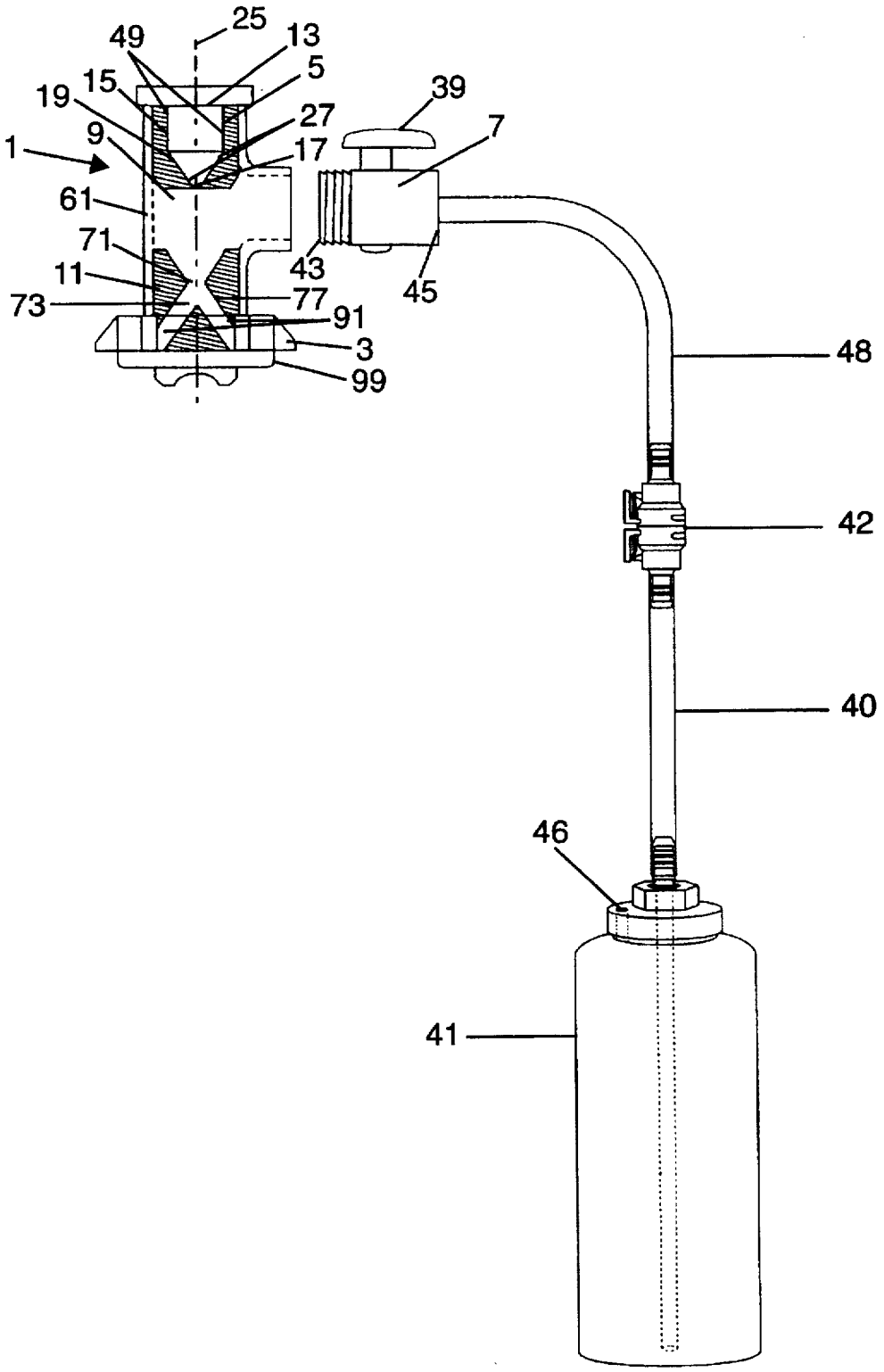
FIG. 2 shows a partial-exploded, partial cross-sectional view of the jet pump of FIG. 1.
Figure 3A:
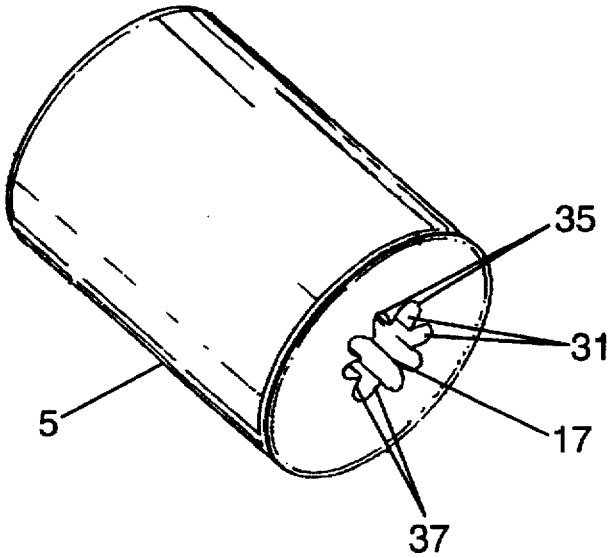
FIG. 3A shows a perspective view of a converging section of a version of a nozzle that may be used in the jet pump of FIG. 1, said nozzle having parallel walls at its outlet orifice.
Figure 3B:
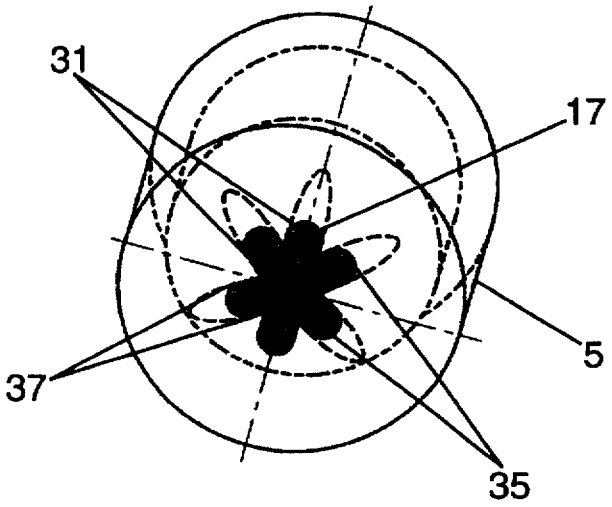
FIG. 3B shows a projected front view of a converging section of a version of a nozzle that may be used in the jet pump of FIG. 1, said nozzle having converging walls at its outlet orifice.

The present invention provides an improved jet pump 61 comprising an improved nozzle 5, an induction passage 7, a mixing chamber 9, a diffuser 11, a distributor 91 and a spray cap 3. An example of the jet pump 61 (or eductor) is a shower head 1. (Please refer to FIG. 1 and FIG. 2.) The nozzle 5, the mixing chamber 9, the diffuser 11, the distributor 91 and the spray cap 3 have a common longitudinal axis 25.

An improved fluid mixing, axisymmetric nozzle 5 with a longitudinal axis 25 is used in the present jet pump 61. In said improved nozzle 5, flow of fluids comprises a primary axial flow and a secondary axial flow. The axisymmetric nozzle 5 comprises a top end 13, a body comprising a cylindrical section 15 and a conical section 19 and a bottom end 17. The conical section 19 is a continuation of the cylindrical section 15. The top end 13 of the nozzle 5 forms an inlet orifice, particularly designed to conform to standard pipe cavities and preferably having a circular shape. The cylindrical section 15 of the nozzle 5 has a cross-sectional area equal to cross-sectional area of the inlet orifice of the top end 13. (Please refer to FIG. 5A.) The conical section 19, having converging walls 27, converges into and terminates at the bottom end 17 of the nozzle 5. The bottom end 17 of the nozzle 5 forms an outlet orifice that serves as an exit for the first fluid from the nozzle 5. The bottom end 17 of the nozzle 5 has a unique configuration specifically designed to improve uniformity of mix and entrainment of fluids without yielding an unequal distribution of energy present in non-circular nozzles. (Please refer to FIG. 3A, FIG. 3B, FIG. 4A, FIG. 4B, FIG. 4C, FIG. 5B and FIG. 5C.) To enhance velocity of the first fluid through the nozzle 5, the outlet orifice of the bottom end 17 of the nozzle 5 has a cross-sectional area that is smaller than the cross-sectional area of the top end 13 of the nozzle 5. (Please refer to FIG. 2 and FIG. 6A.)

In a most preferred embodiment, the nozzle 5 has parallel walls 49 in the cylindrical section 15, from the top end 13 of the nozzle 5 to the intersection of the cylindrical section 15 and the conical section 19. (Please refer to FIG. 2, FIG. 5A and FIG. 6B.) Starting from the intersection of the cylindrical section 15 and the conical section 19, the parallel walls 49 of the nozzle 5 are replaced by converging walls 27 which are tapered to provide for a smooth transition from the top end 13 to the bottom end 17 of the nozzle 5. Relative to the longitudinal axis 25 of the nozzle 5, a taper angle ranging from approximately 12° to approximately 45° may be used for the converging walls 27 of the conical section 19 of the nozzle 5 to facilitate transition of the first fluid from the inlet orifice to the outlet orifice of the nozzle 5 and to provide a relatively good performance. For achieving optimum performance, said converging walls 27 are preferably positioned at a taper angle ranging from approximately 30° to approximately 38° relative to the longitudinal axis 25 of the nozzle 5. (Please refer to FIG. 5A wherein a taper angle of 34° is shown.)

Figure 4A:
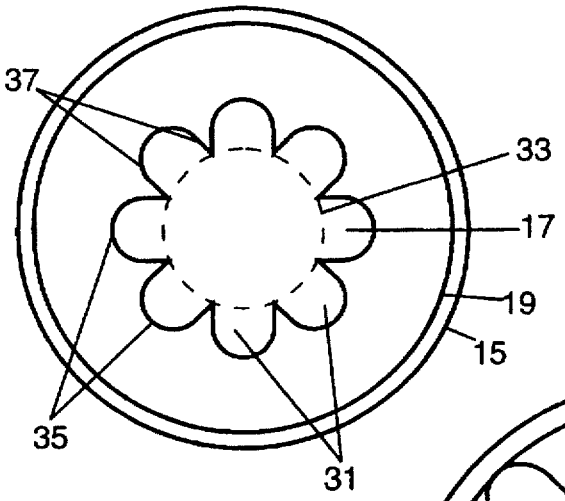
FIG. 4A shows a bottom view of a version of a nozzle that may be used in the jet pump of FIG. 1.
Figure 4B:
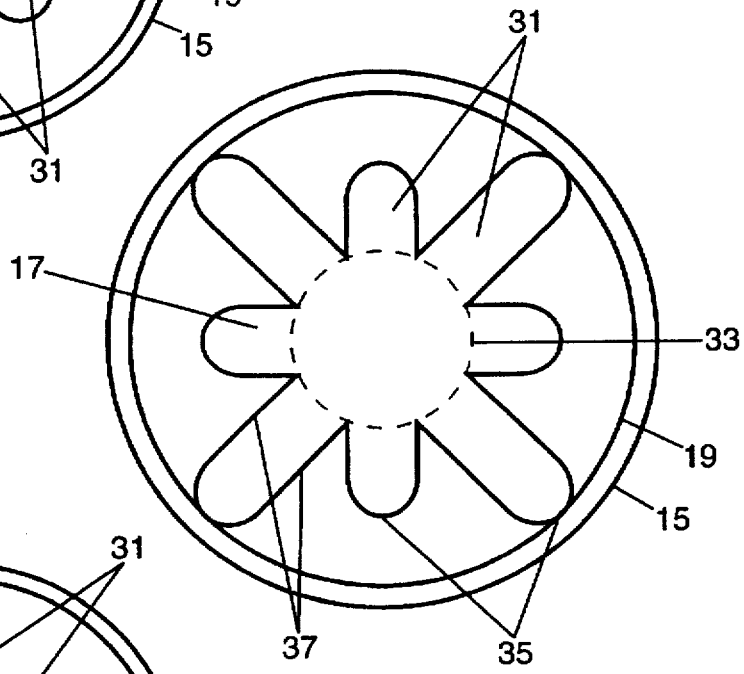
FIG. 4B shows a bottom view of a version of a nozzle that may be used in the jet pump of FIG. 1.
Figure 4C:
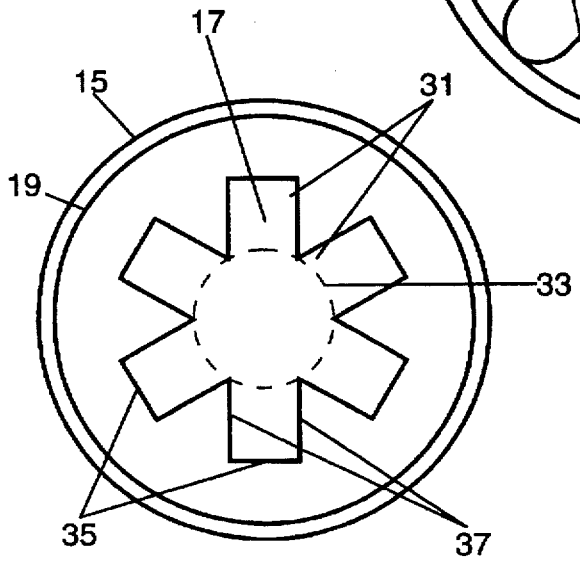
FIG. 4C shows a bottom view of a version of a nozzle that may be used in the jet pump of FIG. 1.
Figure 5A:
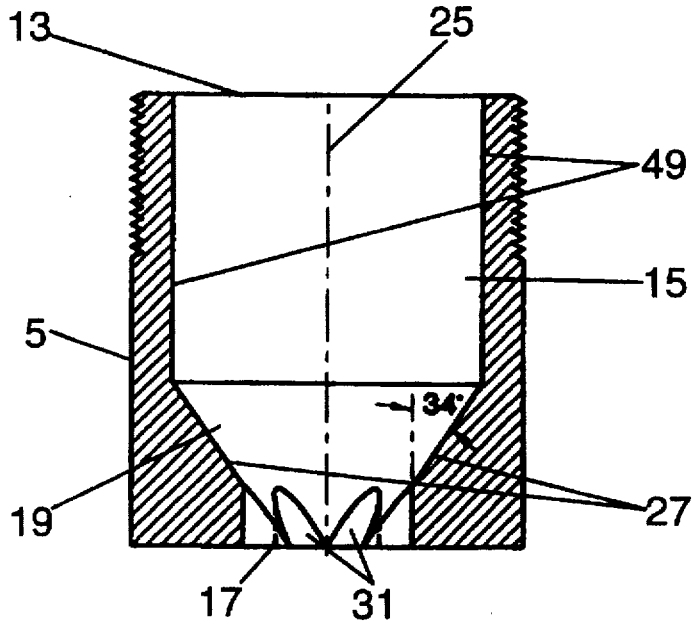
FIG. 5A shows a side-elevational view of a version of a nozzle that may be used in the jet pump of FIG. 1, said nozzle being shown partially in section.
Figure 5B:
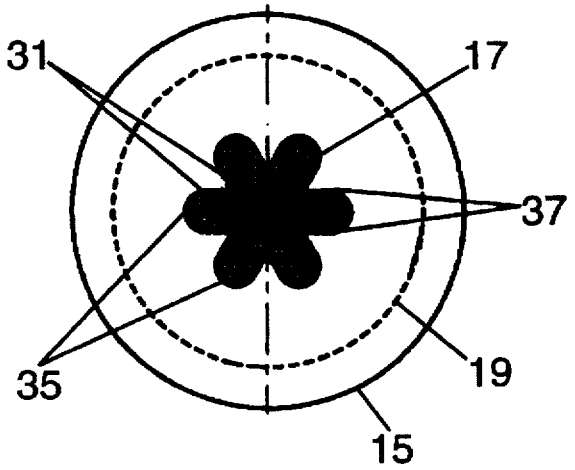
FIG. 5B shows a top view of the nozzle of FIG. 5A.
Figure 5C:
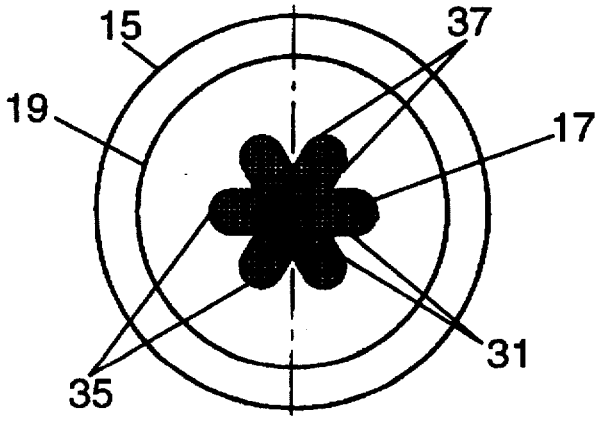
FIG. 5C shows a bottom view of the nozzle of FIG. 5A.

As shown in FIG. 4A, FIG. 4B and FIG. 4C, the bottom end 17 of the nozzle 5 has a geometric configuration consisting of radial projections 31 and a circular, center bore that together form the outlet orifice. The circular, center bore has a circumferential base-line arc 33. Said radial projections 31 each extend outwardly from the circumferential base-line arc 33 to a vertex 35 that has a dimensional relationship to radius of the center bore. It should be emphasized that many different versions of geometric configurations can be used for the bottom end 17 of the nozzle 5. A few examples follow. Aspect ratio of the radial projections 31 (i.e. ratio of radial dimension to tangential dimension for adjacent radial projections 31) may be 1:1 in rotation (as shown in FIG. 4A and FIG. 4C). The aspect ratios may, just as well, alternate (e.g. between 1:2 and 2:1 in FIG. 4B) from one radial projection 31 to a clockwise, or counter-clockwise, adjacent radial projection 31. Radial projections 31 may be rounded, rectangular or truncated at the vertex 35 of their geometric form (as shown in FIG. 4A, FIG. 4B and FIG. 4C). In a most preferred embodiment, the radial projections 31 are arranged in a symmetrically radial and sequential order of rotation around the periphery of the center bore in even numbers of 6, 8, 10 or 12. FIG. 4A shows a bottom end 17 having eight equally-spaced radial projections 31. Said eight equally-spaced radial projections 31 have an aspect ratio of 1:1 and are rounded at their vertex 35. FIG. 4B shows a bottom end 17 that has eight equally-spaced radial projections 31 which have an aspect ratio alternating between 1:2 and 2:1 and which are rounded at their vertex 35. Regardless of the selected configuration, axes symmetry of the outlet orifice of the nozzle 5 shall be maintained. The radial projections 31 have side walls 37 that are continuous and may be parallel and converging or contoured. If taper angles of the contoured side walls 37 for each of the radial projections 31 are equal, the streamwise flows from the radial projections 31 converge at a predetermined point downstream from the outlet orifice of the bottom end 17 of the nozzle 5. However, the taper angle of each side wall 37 may be varied to cause flows from each of the radial projections 31 to intersect at a different point downstream of the nozzle 5, to avoid intersection or to have various points of intersection for different sets of the radial projections 31, to name a few options. In addition to variations in the taper angles, different patterns of the radial projections 31 can create different patterns of chaotic turbulence. Alternating radial sequence of the radial projections 31 in aspect ratios is an example.

Figure 8:
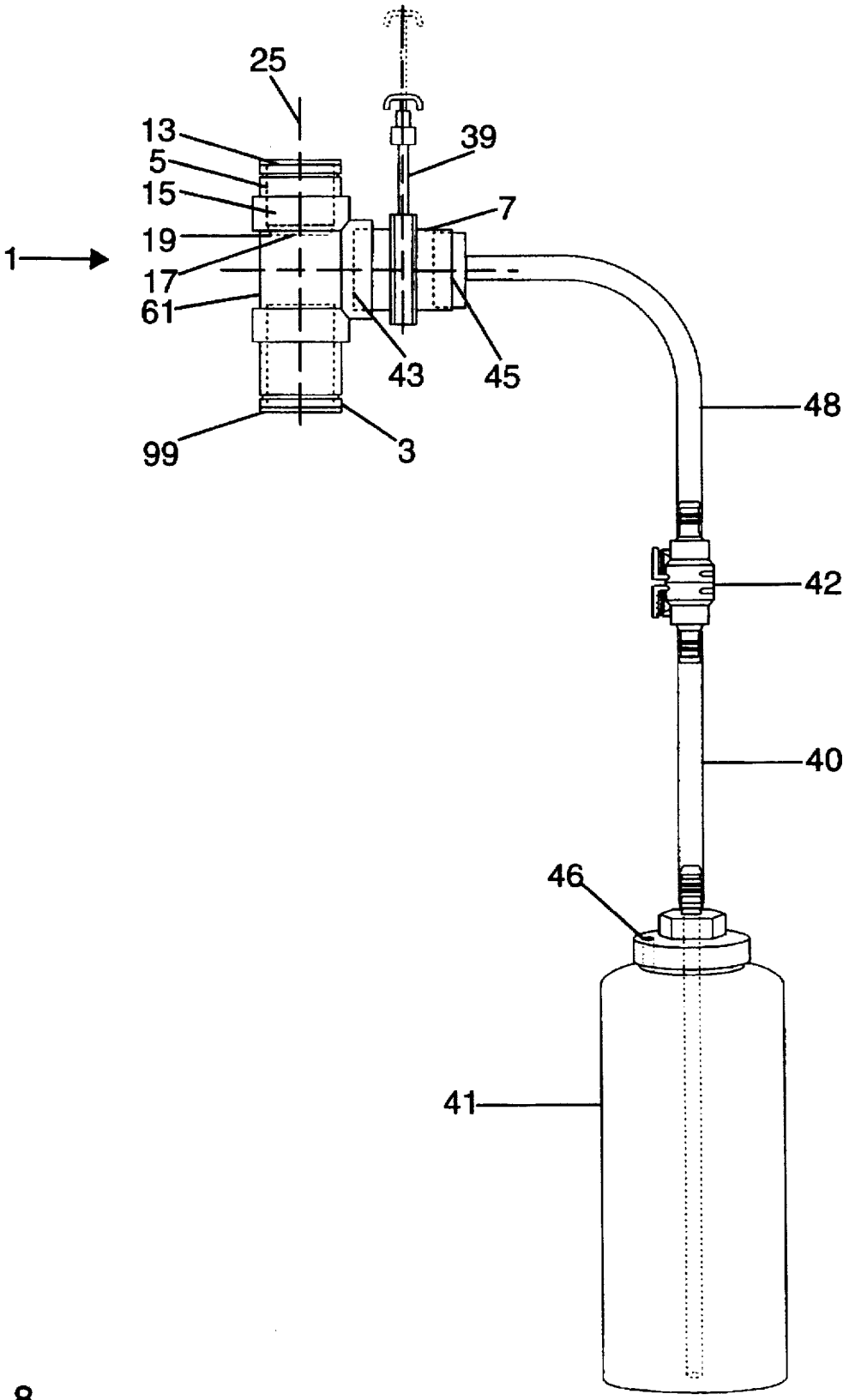
FIG. 8 shows a side view of a version of the improved jet pump of FIG. 1, with manner of attachment of different parts of this version of the jet pump being shown.

The outlet orifice of the bottom end 17 of the nozzle 5 neighbors the mixing chamber 9 wherein the first fluid is thoroughly mixed with a second fluid. The jet pump 61 is particularly designed to prevent existence of any obstructions in the mixing chamber 9. The mixing chamber 9 has a top section, a bottom section and a dimensional length that is equal to or less than external diameter of the jet pump 61. The outlet orifice of the bottom end 17 of the nozzle 5 serves as an entrance for the first fluid into the mixing chamber 9 at a first upstream end thereof. The bottom section 10 of the mixing chamber 9 neighbors the diffuser 11 and has walls that converge. The induction passage 7 neighbors the top section of the mixing chamber 9 and has a first end 43 and a second end 45. In a most preferred embodiment, the induction passage 7 has a longitudinal axis that is perpendicular to the longitudinal axis 25 of the nozzle 5. The first end 43 of the induction passage 7 neighbors the mixing chamber 9 and provides an outlet orifice for the induction passage 7. The second end 45 of the induction passage 7 is attached to a source of the second fluid 41 and provides an inlet orifice for the induction passage 7. (Please refer to FIG. 1, FIG. 2 and FIG. 8.) A valve 39 (for example, a manually-operated valve 39) should be used for controlling the flow of any desired additive which serves as the second fluid to be mixed with the first fluid in the jet pump 61. (Please note that an influent substance may be used, as the second fluid, in mixing with the first fluid as well. In order to facilitate reference to the second fluent or influent substance, both the fluent and influent substance are referred to as the "second fluid".) The valve 39 is positioned between the first end 43 and the second end 45 of the induction passage 7. The valve 39 controls flow of the second fluid through the induction passage 7 into the mixing 30 chamber 9. The second fluid is drawn, from the source of the second fluid 41, through the inlet orifice of and into the induction passage 7. If the valve 39 is open, the second fluid is drawn through the induction passage 7 such that the second fluid enters the mixing chamber 9 upon flowing through the outlet orifice of the induction passage 9. (Please refer to FIG. 8.) A first tube 40, preferably a plastic tube, connects the source of the second fluid 41 to a disconnecting coupling 42. The disconnecting coupling 42 is used to facilitate removal and replacement of the source of the second fluid 41. A second tube 48 connects the disconnecting coupling 42 to the second end 45 of the induction passage 7. To avoid collapse of the source of the second fluid 41 upon evacuation, the source of the second fluid 41 has an air vent 46. Upon turning on the source of the first fluid, a pressurized flow of the first fluid commences through the top end 13, which is connected to the source of the first fluid, of the nozzle 5. Downward flow of the first fluid through the nozzle 5 results in conversion of pressure energy of the first fluid into kinetic energy, and thus in an increase in velocity of the first fluid, in the nozzle 5. Therefore, the pressure adjacent to the outlet orifice of the bottom end 17 of the nozzle 5 and in the mixing chamber 9 is lower than the pressure near the top end 13 of the nozzle 5. If the valve 39 in the induction passage 7 is open, this lower pressure draws the second fluid by suction from the source of the second fluid 41 through the induction passage 7 into the mixing chamber 9. In the most preferred embodiment, a shower head 1 serves as the jet pump 61, water serves as the first fluid and a body care product serves as the second fluid.

A major improvement in the present jet pump 61 is use of a nozzle 5 in which a third order of flow is developed. A third order of flow occurs when alternate projections are different from any adjacent projections. A primary axial flow of the first fluid in the nozzle 5 has an expanding centerline velocity that provides kinetic energy and momentum transfer to the radial projections 31 located around the circumferential, base-line are 33 of the circular, center bore. As the primary axial flow undergoes an increase in velocity during downstream flow through the nozzle 5, boundary layers form between a frictionless (or isentropic) core flow and internal surfaces of the nozzle 5. Internal contours and angles of slope create changes in the symmetry surrounding the longitudinal axis 25 of the nozzle 5, said changes influencing the boundary layers of the primary axial flow as well as rotation of the primary axial flow and resulting in formation of a secondary axial flow. Chaotic turbulent flow and distortions are created in the nozzle 5, causing a reduction in fluid thickness and formation of pressure gradients and generating large-scale streamwise vortices in the shear boundary layer of the primary axial flow and of the secondary axial flow. Large-scale vortice structures, that are being developed in the shear boundary layer of the primary axial flow and of the secondary axial flow, are responsible for growth of mass entrainment and formation of small-scale vortices. Transverse pressure gradients in the large-scale vortices are particularly responsible for development of small-scale vortices. Self-induction created by the small-scale vortices and by the large-scale vortices significantly enhance growth rate of uniform shear layer spreading and mass entrainment.

The bottom end 17 of the nozzle 5 is designed to enhance said chaotic turbulent flow as the first fluid enters the mixing chamber 9. Alternate geometric variations of the radial projections 31 that may be used will change the behavior of the secondary axial flow which controls magnitude of mass entrainment and shear boundary layer spreading rate of the downstream flowfield of the first fluid. Different effects of these alternate geometric variations depend especially on the symmetry and radial curvature of the radial projections 31. In some variations, the radial projections 31 have unequal vectors adjacent to the symmetrical longitudinal axis 25, resulting in increased distortion in shear boundary layer of the secondary axial flow. Flow instabilities at the shear boundary layer of the primary axial flow, along with the pressure loss in the region of increased velocity of the primary axial flow, result in enhanced entrainment of the second fluid by the first fluid in the mixing chamber 9 to form an entrained mixture. Sufficient loss in pressure is created at periphery of the outlet orifice of the nozzle 5 to draw, by suction, a regulated second fluid at varied pressure ranges from a source of the second fluid 41 into the mixing chamber 9. As a result, the first fluid and the second fluid are mixed both radially and axially. The second fluid is then thoroughly and uniformly mixed with the first fluid in the mixing chamber 9 to form an entrained mixture with a three-dimensional flow.

The entrained mixture then leaves the mixing chamber 9 at a distal downstream end of the bottom section of the mixing chamber 9. The entrained mixture enters the diffuser 11 wherein static pressure is substantially recovered from the entrained mixture, minimizing dissipation of energy of and resulting in a decrease in velocity of the entrained mixture. The diffuser 11 has a top end 71 serving as an inlet orifice, a bottom end 73 serving as an outlet orifice and diverging walls 77 forming a flow passage. In a most preferred embodiment, the diffuser 11 has a conical shape. (Please refer to FIG. 2 and FIG. 6B.) The top end 71 of the diffuser 11 has a cross-sectional area and the bottom end 73 of the diffuser 11 has, in comparison, a smaller cross-sectional area, with the entrained mixture being dispelled out of the diffuser 11 through the cross-sectional area of the bottom end 73. The entrained mixture is distributed at a uniform velocity across the cross-sectional area of the top end 71 of the diffuser 11.

The diffuser 11 is used to complete a final step in a process based on the "jet pump and eductor principle". The different steps of said principle are carried out by different components of the jet pump 61 that have been already described. The nozzle 5 converts pressure energy into kinetic energy, creating sufficient loss in pressure to induce suction of the second fluid through the induction passage 7. In the mixing chamber 9, the second fluid is entrained by shear at periphery of the outlet orifice of the nozzle 5. The next step is the uniform conversion of kinetic energy to pressure energy of the entrained mixture and is the responsibility of the diffuser 11.

Unlike the nozzle 5 which is generally a converging duct, the diffuser 11 is an expanding duct and has diverging walls 77. As demonstrated above, the primary purpose of the nozzle 5 is to convert the potential energy of a static differential in pressure between two points (i.e. the top end 13 and the bottom end 17 of the nozzle 5) in a field into kinetic energy of fluid flow. In contrast, the primary purpose of the diffuser 11, being an energy concentrator and pressure recovery tube, is to substantially recover static pressure from a fluid stream while reducing the flow velocity.

Due to high energy losses in a mixing chamber, use of a combination of a nozzle 5 and a mixing chamber 9 is not as efficient as using the diffuser 11 along with the combination, which includes the diffuser 11 positioned downstream of the nozzle 5 and the mixing chamber 9. Geometry of design and expansion of the emitting stream from the nozzle 5 in the mixing chamber 9, by developing turbulence, reduction in momentum and dissipation of energy upon contact with the second fluid, cause energy losses. In the present invention, the diffuser 11 is being used to substantially recover some of these energy losses. In order to accomplish effective and efficient pressure recovery and to substantially recover some energy losses in the jet pump 61, the diffuser 11 used in the present invention diffuses a three-dimensional flow.

Degradation of pressure in diffusers that are applied to jet pumps which provide two-dimensional flows results from frictional losses, turbulence and flow separation in the diffusers. If angle of walls of diffusers is too large (i.e. the walls are too steep), separation will occur, resulting in inefficient pressure recovery and inefficient velocity reduction. If the angle of walls is too small, an excessive length is required to obtain a given pressure resulting in large frictional losses. Therefore, the design of diffusers that are applied to jet pumps which provide two-dimensional flows is one of a compromise of length and angle of walls of the diffusers.

It has been shown in experiments that by using the improved nozzle 5 in the jet pump 61, large-scale vortices created by turbulent flow generated in the nozzle 5 are emitted from the outlet orifice of the nozzle 5. These large-scale vortices travel through the mixing chamber 9 and physically sweep through the diffuser 11. The turbulent sweep through the diffuser 11 energizes the near-wall fluid or energizes the boundary layer of the diffuser 11. The pressurized conditions energize the boundary layer of the diffuser 11. The resulting turbulence suppresses flow separation and minimizes frictional losses in the diffuser 11. The diffuser 11 is hydrodynamically designed to reduce wall separation which ultimately will cause back pressure. Creation of chaotic turbulence and minimization of flow separation and of frictional losses result in a more efficient diffuser 11 with a relatively high pressure recovery in comparison with diffusers applied to jet pumps which provide a two-dimensional flow. In addition, turbulence in the diffuser 11 enhances mixing of the first fluid and the second fluid. Upon creation of strong vortice structures by using turbulent flow, rather than laminar flow, the fluid mechanic laws pertaining to boundary-layer separation from the wall do not seem to apply (i.e. low-degree angles requiring excessive length to obtain a given pressure, thus resulting in large friction losses, and high-degree angles resulting in separation, inefficient pressure recovery and inefficient velocity reduction). The diffuser 11 may be capable of providing a substantially larger angle of divergence than existing diffusers used in jet pumps which provide a two-dimensional flow do, while providing a more efficient and an increased pressure recovery. In addition, the diffuser 11 used in the jet pump 61 which provides a three-dimensional flow is capable of providing a substantially larger angle of convergence than existing diffusers used in jet pumps which provide a two-dimensional flow do. A more efficient and increased pressure recovery, obtained and maintained by the diffuser 11 used in the jet pump 61 which provides a three-dimensional flow, will be in a range of eighty percent (80%). Fluid flow velocity is uniformly converted into static pressure with a minimum loss of energy. With its mixing ability, with its ability to recover a substantial portion of pressure lost in the nozzle 5, and with its ability to use a shorter diffuser 11 to achieve a more efficient result than existing jet pumps do, the improved jet pump 61 can be used in many different applications with lower costs and higher efficiency rates. In addition, the improved jet pump 61 may be used as a retrofit with existing diffusers to improve their mixing capability and pressure recovery efficiency. Upon using a diffuser of any desired length and designed for jet pumps which provide a two-dimensional flow, a pressure in the range of a perfect vacuum can be obtained by the jet pump 61 that provides a three-dimensional flow.

Figure 9:
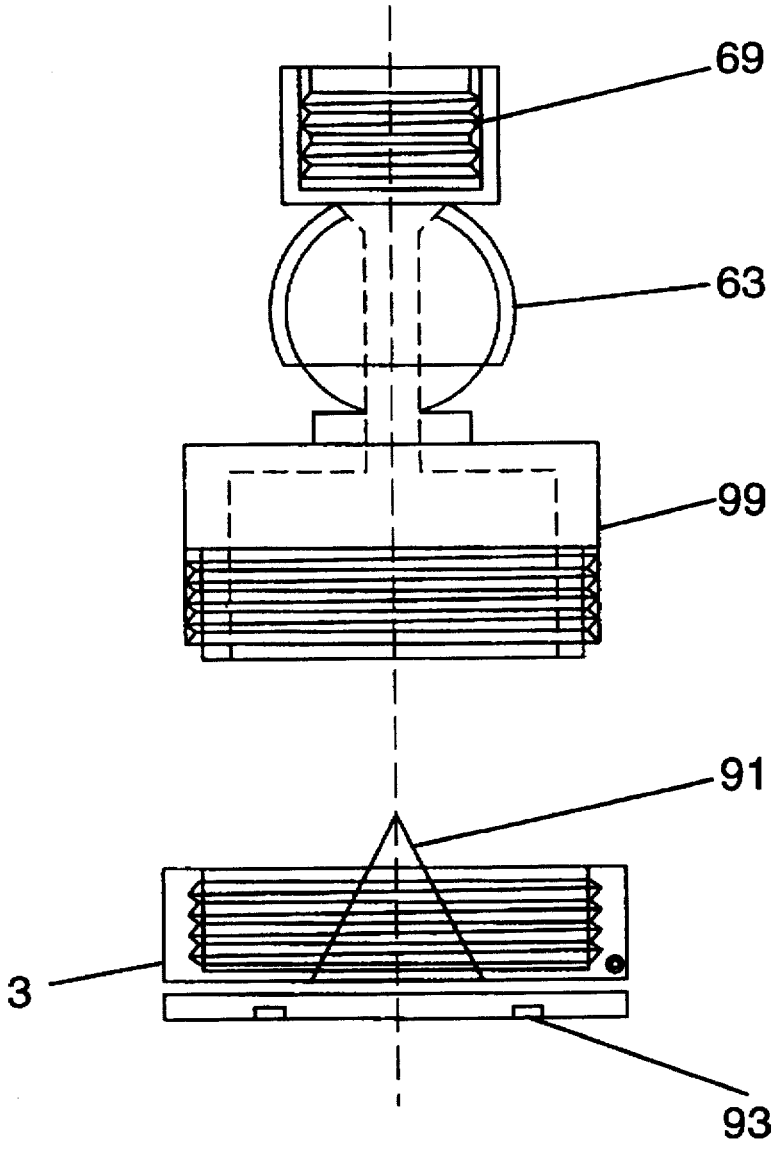
FIG. 9 is a partial-exploded side view of a spray head housing that may be used in the jet pump of FIG. 1, said spray head housing being shown partially in section.

The diffuser 11 provides a strong and cohesive pressurized, diffused mixture that passes through the distributor 91. The diffused mixture is dispelled into the distributor 91 at a pressure greater than the pressure of the entrained mixture but less than the pressure of the first fluid at the top end 13 of the nozzle 5. The distributor 91 deflects and uniformly discharges the pressurized, diffused mixture towards the spray cap 3. The distributed mixture is directed by the distributor 91 to a spray head housing 99 that comprises an adjustable ball-and-socket joint assembly 63 and a coupling 69. The ball-and-socket joint assembly 63 attaches to the distributor 91 on an upstream end of the spray head housing 99. The coupling 69, that is preferably threaded, attaches to the spray cap 3 on a downstream end of the spray head housing 99. (Please refer to FIG. 9.) The spray cap 3 has orifices 93 that are located radially from inward base of the distributor 91 which extends outwardly to circumference of the spray cap 3 (as shown in FIG. 7 and FIG. 9). The pressurized, blended and homogeneous mixture is forced out of the orifices 93 of the spray cap 3 in a uniform and invigorating liquid spray.

Figure 10:
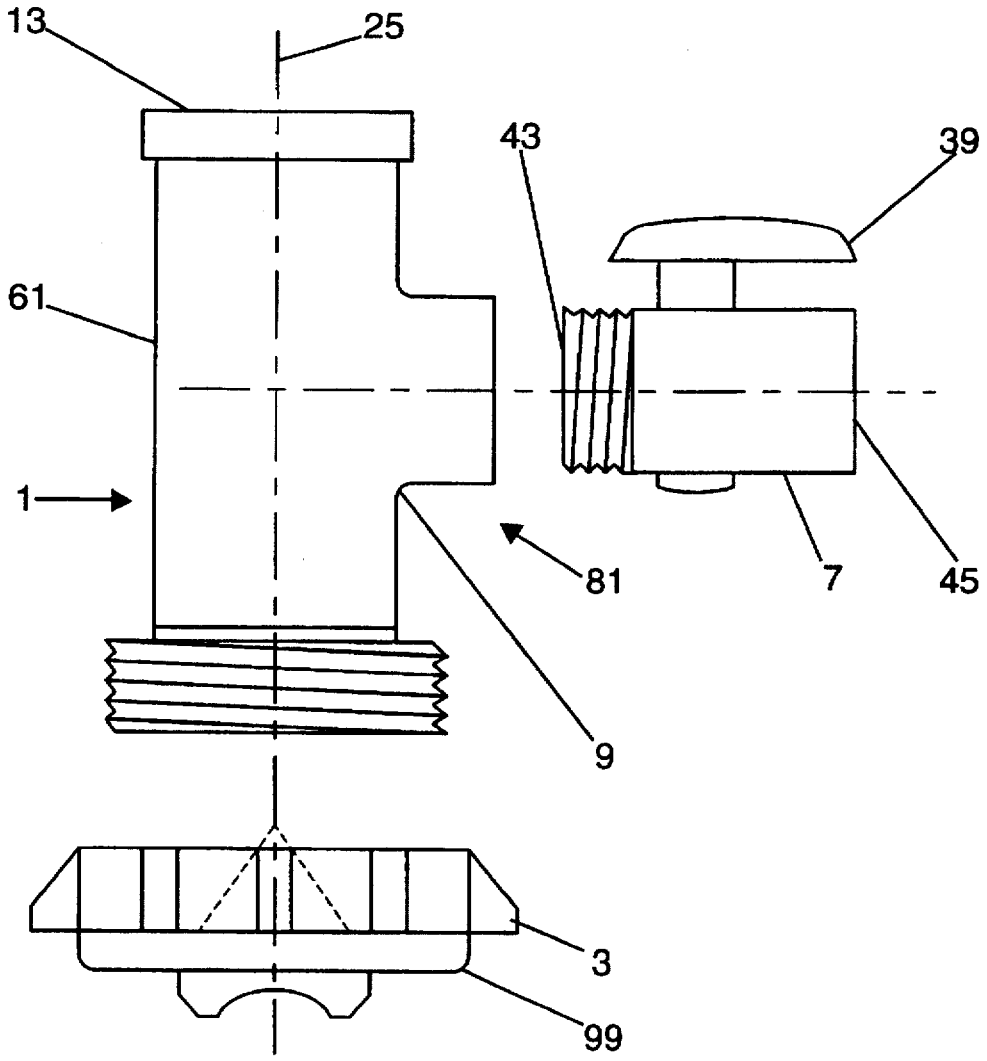
FIG. 10 shows a partial-exploded side view of a version of the improved jet pump of FIG. 1, with this version of the jet pump serving as an aerator.

In a version of the present improved jet pump 61, the induction passage 7 may be used as an aerator 81. (Please refer to FIG. 10.) Thus, the second fluid, instead of being a body care product from the source of the second fluid 41, is ambient air. The entrained air in the first fluid (e.g. water) provides a softer sensation on skin or body of the user and has an aesthetic value. Aeration of water of the jet pump 61 has been a step in direction of conservation of the first fluid. The space occupied by the induced air may be equal to the space occupied by water. Therefore, the consumption of water can be reduced by fifty percent (50%). True and effective aeration requires aspiration of air through the induction passage 7 of the aerator 81. Ambient air is drawn into the mixing chamber 9 by being directed from the second end 45 of the induction passage 7, through the induction passage 7 and out of the first end 43 of the induction passage 7. Ambient air plays the role of the second fluid and undergoes the same procedure that any second fluid does. The only difference in using the induction passage 7 as an aerator 81 is lack of attachment of a container of the second fluid to the jet pump 61. (Please compare FIG. 2 with FIG. 8.) Ambient air is the second fluid.

In summary, as explained in separate paragraphs in this specification, the jet pump 61 of the present invention operates as follows. In operation, the pressurized first fluid enters the jet pump 61 through the inlet orifice of the nozzle 5. In the nozzle 5, the first fluid undergoes a loss in pressure and an increase in velocity. Said lower pressure draws in the second fluid through the induction passage 7, with the flow of the second fluid through the induction passage being preferably perpendicular to the flow of the first fluid through the nozzle 5 (i.e. to the longitudinal axis 25 of the nozzle 5), into the mixing chamber 9. Flow of the second fluid from the source of the second fluid 41 (or from ambient air) is controlled by the valve 39. The mixing chamber 9, that is below the outlet orifice of the nozzle 5, provides intimate mixing of the second fluid with the first fluid. The entrained mixture of the first fluid and of the second fluid enters the diffuser 11 which recovers a portion of the lost pressure. The diffuser 11 provides a strong and cohesive pressurized, diffused mixture that passes through the distributor 91 which uniformly deflects and discharges the pressurized mixture towards the spray cap 3. The pressurized mixture is forced out of the orifices 93 of the spray cap 3 in a uniform and invigorating liquid spray.

Because of the water conservation feature, the jet pump 61 is more economical than ejectors that have been developed. In addition, the jet pump 61 is durable in construction, readily and easily installable and replaceable, simple in operation, safe and secure.

Certain objects are set forth above and made apparent from the foregoing description, drawings and examples. However, since certain changes may be made in the above description, drawings and examples without departing from the scope of the invention, it is intended that all matters contained in the foregoing description, drawings and examples shall be interpreted as illustrative only of the principles of the invention and not in a limiting sense. With respect to the above description and examples then, it is to be realized that any descriptions, drawings and examples deemed readily apparent and obvious to one skilled in the art and all equivalent relationships to those stated in the examples and described in the specification or illustrated in the drawings are intended to be encompassed by the present invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention. It is also to be understood that the following claims are intended to cover all of the generic and specific features of the invention herein described, and all statements of the scope of the invention which, as a matter of language, might be said to fall therebetween.

What is claimed as invention is:

1. An apparatus serving as a jet pump for mixing fluids and for providing a three-dimensional flow, said apparatus comprising:

(a) a three-dimensional axisymmetric nozzle having i. a top end providing an inlet orifice which serves as an entrance for a first fluid under pressure into the apparatus, ii. a body comprising a cylindrical section and a conical section which has downwardly converging walls and is a continuation of the cylindrical section, and iii. a bottom end providing an outlet orifice that serves as an exit for the first fluid from the nozzle and having a geometric configuration that consists of:

A. a circular, center bore having a circumferential base-line arc, and

B. radial projections each extending outwardly from the circumferential base-line arc to a corresponding vertex;

(b) a mixing chamber, lacking any obstructions therein, neighboring the bottom end of the nozzle, with the outlet orifice of the nozzle serving as entrance for the first fluid into the mixing chamber at a first upstream end thereof, and having a top section and a bottom section that has converging walls;

(c) an induction passage having an inlet orifice for flow of a second fluid from a source of the second fluid into the induction passage, an outlet orifice for flow of the second fluid from the induction passage into the top section of the mixing chamber and a valve that controls flow of the second fluid into the mixing chamber wherein the first fluid is thoroughly mixed with the second fluid;

(d) a conical diffuser, having a top end which serves as an inlet orifice and which is at a distal downstream end of the bottom section of the mixing chamber, diverging walls and a bottom end which serves as an outlet orifice, with cross-sectional area of the inlet orifice of the diffuser being smaller than said cross-sectional area of the outlet orifice of the diffuser; and (e) a distributor having an inward base, being connected to the bottom end of the diffuser, sharing a longitudinal axis with the nozzle, the mixing chamber and the diffuser and extending outwardly to circumference of a spray cap which has orifices located radially from the inward base of the distributor;

such that the three-dimensional nozzle generates a chaotic, turbulent flow that enhances entrainment of the second fluid by the first fluid in the mixing chamber, that increases efficiency of the jet pump and that allows a decrease in length of the diffuser.

2. The apparatus of claim 1, wherein a shower head serves as the jet pump, water serves as the first fluid and a body care product serves as the second fluid.

3. The apparatus of claim 1, wherein, relative to the longitudinal axis of the nozzle, a taper angle ranging from approximately 12° to approximately 45° may be used for the converging walls of the conical section of the nozzle to facilitate transition of the first fluid from the inlet orifice to the outlet orifice of the nozzle.

4. The apparatus of claim 3, wherein, for achieving optimum performance, the converging walls of the conical section of the nozzle are preferably positioned at a taper angle ranging from approximately 30° to approximately 38° relative to the longitudinal axis of the nozzle.

5. The apparatus of claim 1, wherein the spray cap is connected to a spray head housing comprising:

(a) an adjustable ball-and-socket joint assembly that is connected to the distributor on an upstream end of the spray head housing, and (b) a coupling that is attached to the spray cap on a downstream end of the spray head housing.

6. The apparatus of claim 1, wherein the flow of the second fluid through the induction passage is perpendicular to the flow of the first fluid through the nozzle.

7. The apparatus of claim 1, wherein the mixing chamber has a dimensional length that is at most equal to external diameter of the jet pump.

8. The apparatus of claim 1, wherein the induction passage comprises:

(a) a first end that provides the outlet orifice for the induction passage; and (b) a second end that provides the inlet orifice for the induction passage and is connected by tubes to the source of the second fluid which has an air vent for avoiding collapse of the source of the second fluid upon evacuation of the source, with the tubes consisting of a first tube which connects the source of the second fluid to a disconnecting coupling and a second tube which connects the disconnecting coupling to the second end of the induction passage;

such that removal and replacement of the source of the second fluid may be facilitated by using the disconnecting coupling.

9. The apparatus of claim 1, wherein the induction passage serves as an aerator, with ambient air being used as the second fluid and being inserted into the mixing chamber through the induction passage.

10. The apparatus of claim 1, wherein the bottom end of the nozzle can have various geometric configurations that are differentiated by differences in shape, size, taper angle and aspect ratio of the radial projections and that are responsible for creating various flow patterns of the first fluid and for creating various patterns of chaotic turbulence.

11. The apparatus of claim 1, wherein the diffuser used in the jet pump which provides three-dimensional flow has an angle of convergence that is substantially larger than angle of convergence of existing diffusers used in jet pumps which provide two-dimensional flow.

12. The apparatus of claim 1, wherein the diffuser used in the jet pump which provides three-dimensional flow has an angle of divergence that is substantially larger than angle of divergence of existing diffusers used in jet pumps which provide two-dimensional flow.

* * * * *